US006615743B2

(12) United States Patent
Nien

(10) Patent No.: US 6,615,743 B2
(45) Date of Patent: Sep. 9, 2003

(54) FOLDING TABLE

(76) Inventor: Chou-Chin Nien, No. 9-7, Cheng-Hsing Rd., Heng-Shan Tsun, Ta-Ya Hsiang, Taichung Hsien (TW)

( * ) Notice: Subject to any disclaimer, the term of this patent is extended or adjusted under 35 U.S.C. 154(b) by 0 days.

(21) Appl. No.: 09/921,049

(22) Filed: Aug. 2, 2001

(65) Prior Publication Data

US 2003/0024445 A1 Feb. 6, 2003

(51) Int. Cl.[7] ..... A47B 3/00
(52) U.S. Cl. ..... 108/132; 108/129
(58) Field of Search ..... 108/115, 129, 108/130, 131, 132; 248/439

(56) References Cited

U.S. PATENT DOCUMENTS

| | | | | | |
|---|---|---|---|---|---|
| 2,474,450 | A | * | 6/1949 | Woodruff | 108/132 |
| 2,756,082 | A | * | 7/1956 | Pucci | 108/131 |
| 3,416,468 | A | * | 12/1968 | Peterson et al. | 108/131 |
| 4,559,878 | A | * | 12/1985 | Colby | 108/129 |
| 5,141,197 | A | * | 8/1992 | Mackaay | 248/188.5 |
| 5,357,872 | A | * | 10/1994 | Wilmore | 108/132 |
| 5,662,298 | A | * | 9/1997 | Collins | 108/125 |
| 5,865,128 | A | * | 2/1999 | Tarnay | 108/131 |
| 5,983,807 | A | * | 11/1999 | Tarnay et al. | 108/131 |
| 6,058,853 | A | * | 5/2000 | Pinch | 108/129 |
| 6,112,674 | A | | 9/2000 | Stanford | |
| 6,371,034 | B1 | * | 4/2002 | Simpson et al. | 108/129 |

FOREIGN PATENT DOCUMENTS

| | | | |
|---|---|---|---|
| DE | 3827827 | * | 2/1990 |
| FR | 2686003 | * | 7/1993 |

* cited by examiner

*Primary Examiner*—Lanna Mai
*Assistant Examiner*—Hanh V. Tran
(74) *Attorney, Agent, or Firm*—Harness, Dickey & Pierce, P.L.C.

(57) ABSTRACT

A folding table includes a pair of support pedestals, a longitudinal support rail, a pair of foldable support braces, and a table top. The longitudinal support rail extends in a longitudinal direction, and has opposite rail ends disposed respectively on top of intermediate segments of end rails of the support pedestals. Each of the support braces includes a pedestal connecting portion and a rail connecting portion. The pedestal connecting portion has a first end connected pivotally to a respective one of the support pedestals, and an opposite second end. The rail connecting portion has a first end connected pivotally to the support rail, and an opposite second end connected pivotally to the second end of the pedestal connecting portion. The support rail and the end rails against a bottom surface of the table top.

9 Claims, 7 Drawing Sheets

FOLDING TABLE

BACKGROUND OF THE INVENTION

1. Field of the Invention

The invention relates to a folding table, more particularly to a folding table which bears a load evenly and which is resistant to deformation.

2. Description of the Related Art

U.S. Pat. No. 6,112,674 discloses a folding table, which includes a table top, a pair of support pedestals pivotally attached to the table top, a pair of pivotal support braces and a retaining assembly. Each of the support braces, which have proximal and distal ends, is attached to a respective one of the support pedestals at the proximal end thereof. The distal ends of the support braces are pivotally attached to the retaining assembly, which is mounted in relation to the table top. Because the distal ends of the support braces are connected to a central supporting point of the table top via the retaining assembly, when a load is borne on the table top at a position distal from the central supporting point, a sufficient and even support can not be provided and thus, the table top is liable to deform.

SUMMARY OF THE INVENTION

Therefore, the object of the present invention is to provide a folding table which bears a load evenly and which is resistant to deformation.

Accordingly, the folding table of this invention includes a pair of support pedestals, a longitudinal support rail, a pair of foldable support braces, and a table top.

The support pedestals are spaced apart from each other in a longitudinal direction. Each of the support pedestals has a top end formed with an end rail that extends in a transverse direction transverse to the longitudinal direction, and a bottom end adapted to be placed on a ground surface. The end rail has distal end segments opposite to each other in the transverse direction, and an intermediate segment between the distal end segments.

The longitudinal support rail extends in the longitudinal direction, and has opposite rail ends disposed respectively on top of the intermediate segments of the end rails of the support pedestals.

Each of the support braces includes a pedestal connecting portion and a rail connecting portion. The pedestal connecting portion has a first end connected pivotally to a respective one of the support pedestals, and an opposite second end. The rail connecting portion has a first end connected pivotally to the support rail, and an opposite second end connected pivotally to the second end of the pedestal connecting portion.

The table top has a top surface and a bottom surface. The support rail abuts against the bottom surface of the table top. The end rails of the support pedestals are pivotally retained on the bottom surface of the table top.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
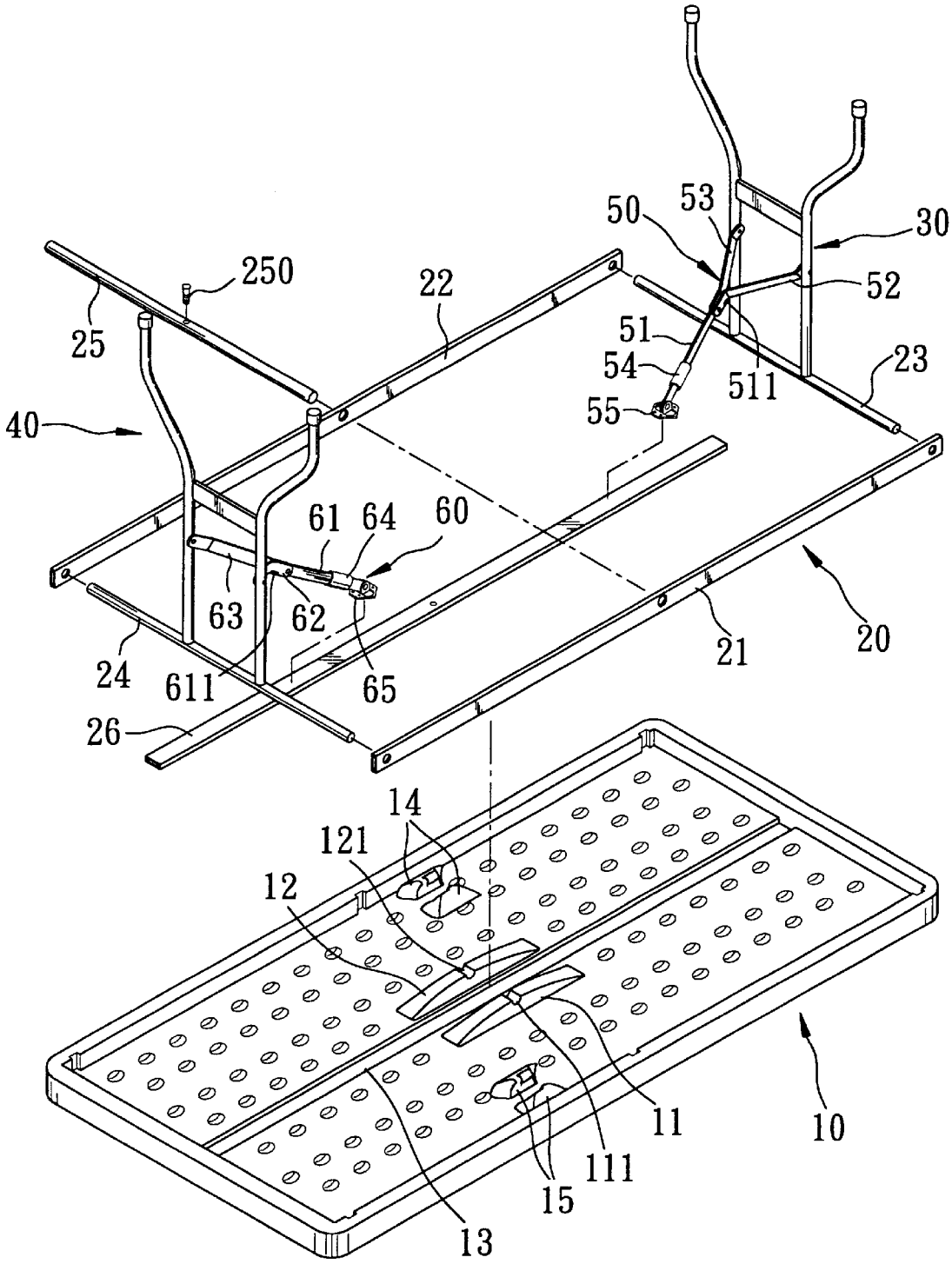
FIG. 1 is an exploded bottom perspective view of the preferred embodiment of the folding table according to this invention.
Figure 2:
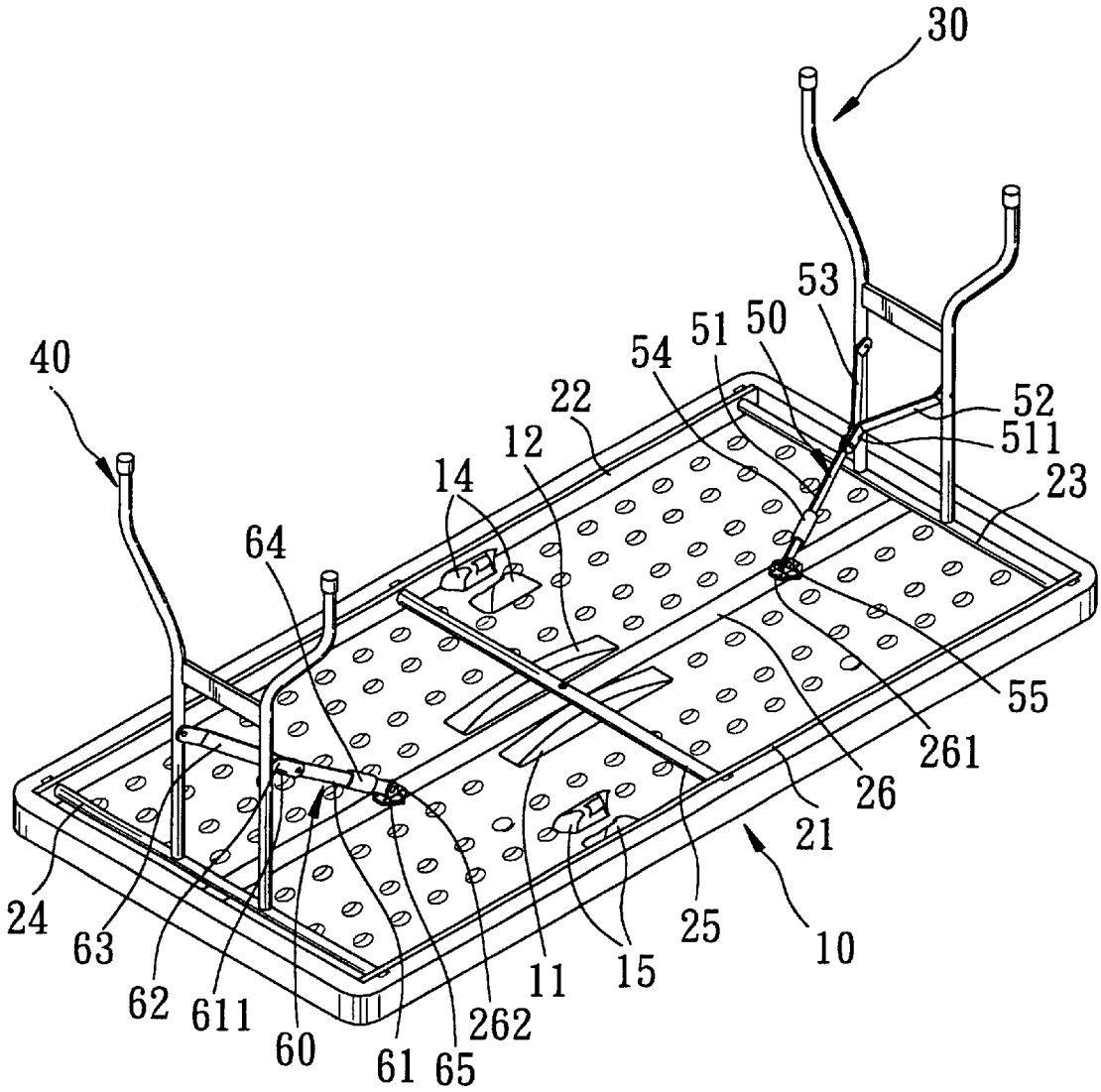
FIG. 2 is a bottom perspective view of the folding table of FIG. 1 in an assembled state.

Referring to FIGS. 1 and 2, the preferred embodiment of the folding table according to this invention is shown to include a pair of support pedestals 30, 40, a longitudinal support rail 26, a pair of foldable support braces 50, 60, and a table top 10.

The support pedestals 30, 40 are spaced apart from each other in a longitudinal direction. Each of the support pedestals 30, 40 has a top end formed with an end rail 23, 24 that extends in a transverse direction transverse to the longitudinal direction, and a bottom end adapted to be placed on a ground surface. Each end rail 23, 24 has distal end segments opposite to each other in the transverse direction, and an intermediate segment between the distal end segments.

The longitudinal support rail 26 extends in the longitudinal direction, and has opposite rail ends disposed respectively on top of the intermediate segments of the end rails 23, 24 of the support pedestals 30, 40.

Figure 3:
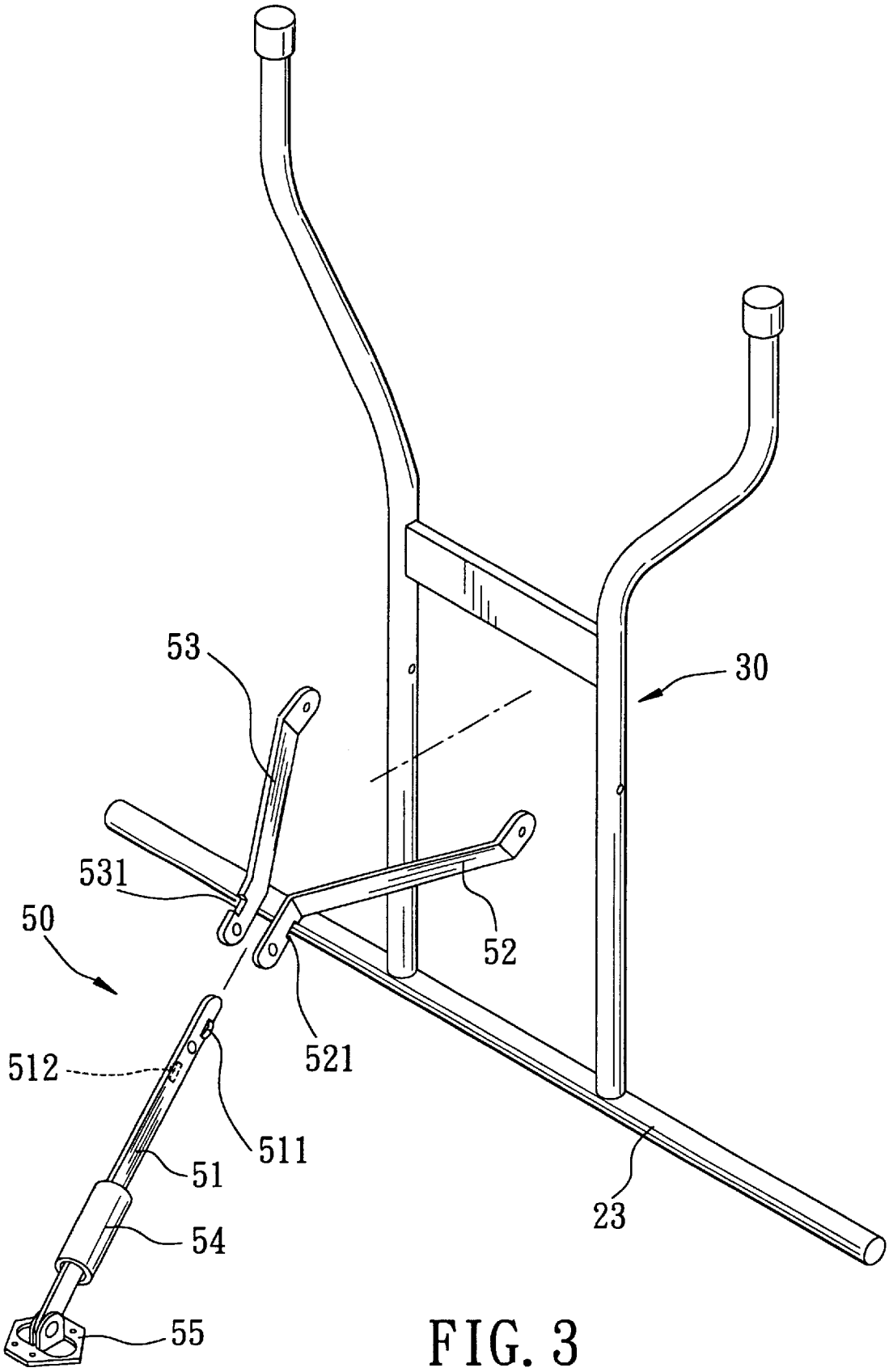
FIG. 3 is an exploded perspective view showing a first support pedestal and a first foldable support brace of the folding table of FIG. 1.
Figure 4:
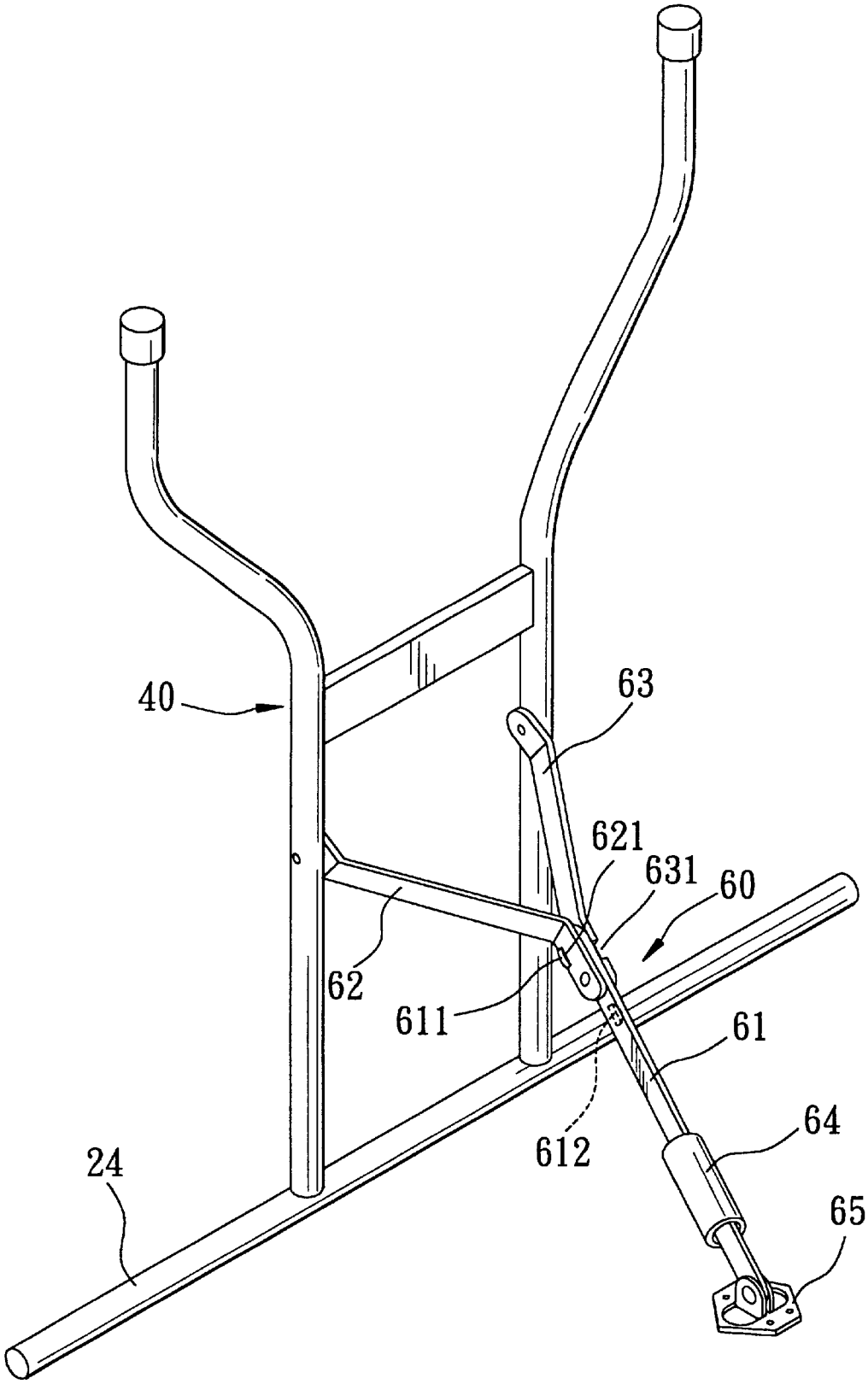
FIG. 4 is a perspective view showing a second support pedestal and a second foldable support brace of the folding table of FIG. 1 in an assembled state.
Figure 5:
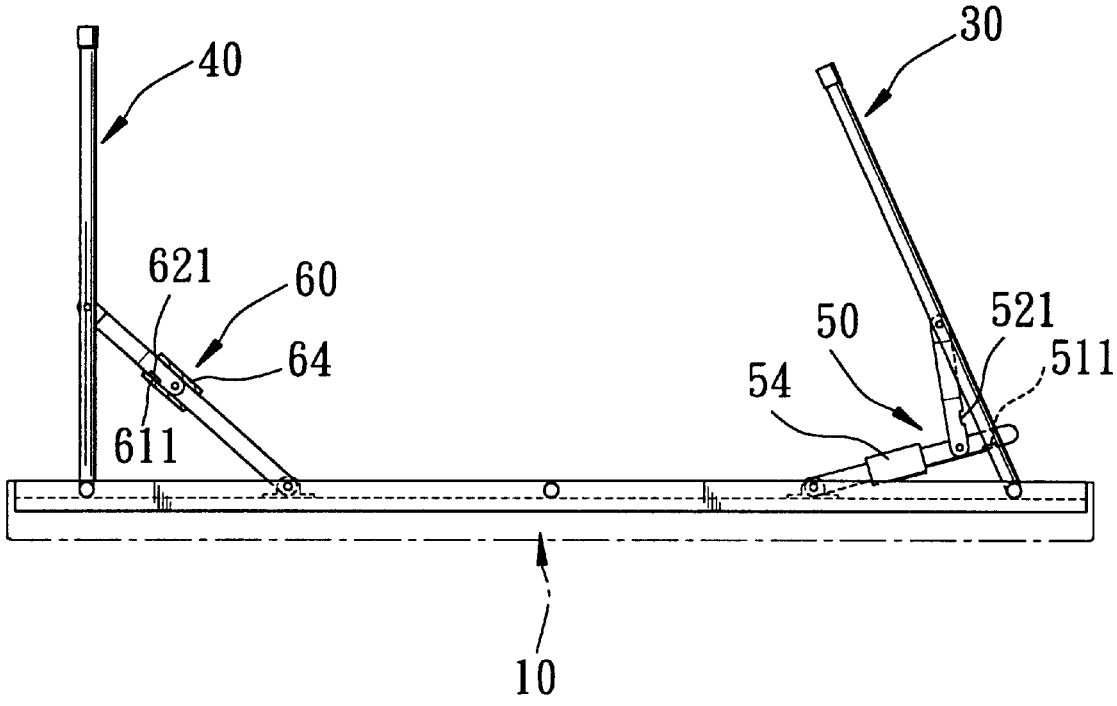
FIG. 5 is a schematic view of the preferred embodiment showing one of the support pedestals is in a collapsing state.

Referring to FIGS. 3, 4 and 5, each of the support braces 50, 60 includes a pedestal connecting portion formed from two angled links 52, 53, 62, 63 and a rail connecting portion 51, 61. Each angled link 52, 53, 62, 63 has a first end connected pivotally to a respective one of the support pedestals 30, 40, and an opposite second end. The rail connecting portion 51, 61 has a first end 55, 65 connected pivotally to the support rail 26, and an opposite second end connected pivotally to the second end of the respective pair of angled links 52, 53, 62, 63. The rail connecting portions 51, 61 of the support braces 50, 60 are connected pivotally to the support rail 26 at two supporting points 261, 262 that are spaced apart from each other along the longitudinal direction. Each of the support braces 50, 60 further includes a locking collar 54, 64 sleeved on the rail connecting portion 51, 61 and slidable therealong so as to conceal the second ends of the angled links 52, 53, 62, 63 and the rail connecting portion 51, 61 therein in order to maintain the support brace 50, 60 in an unfolded state. In this embodiment, each of the angled links 52, 53, 62, 63 of each of the support braces 50, 60 is formed with a notch 521, 531, 621, 631. The rail connecting portion 51, 61 of each of the support braces 50, 60 is formed with a pair of projections 511, 512, 611, 612 that extend into a corresponding one of the notches 521, 531, 621, 631 so as to help position the support brace 50, 60 in an unfolded state or in a folded state. It should be apparent to one skilled in the art that the positions of the notches and the projections on the support braces 50, 60 can be interchanged to achieve the same result.

The table top 10 has a top surface and a bottom surface. The support rail 26 abuts against the bottom surface of the table top 10.

Referring back to FIG. 1, the preferred embodiment of the folding table according to this invention further includes a pair of side rails 21, 22 and a cross rail 25.

The side rails 21, 22 extend in the longitudinal direction, are spaced apart from each other in the transverse direction, and have the support rail 26 disposed therebetween. Each of the side rails 21, 22 has opposite ends connected pivotally and respectively to an adjacent pair of the distal end segments of the end rails 23, 24 of the support pedestals 30,40 so as to form a frame 20. Each of the side rails 21, 22 is mounted securely on the bottom surface of the table top 10. The end rails 23, 24 of the support pedestals 30, 40 are thus pivotally retained on the bottom surface of the table top 10.

The cross rail 25 extends in the transverse direction, is disposed between the end rails 23, 24 of the support pedestals 30, 40, and is spaced apart from the end rails 23, 24 in the longitudinal direction. The cross rail 25 has opposite rail ends connected respectively to the side rails 21, 22, and an intermediate rail portion that is disposed between the rail ends. The intermediate rail portion is disposed below and supports the support rail 26 thereon. The cross rail 25 is fastened to the support rail 26 by a screw fastener 250.

Figure 6:
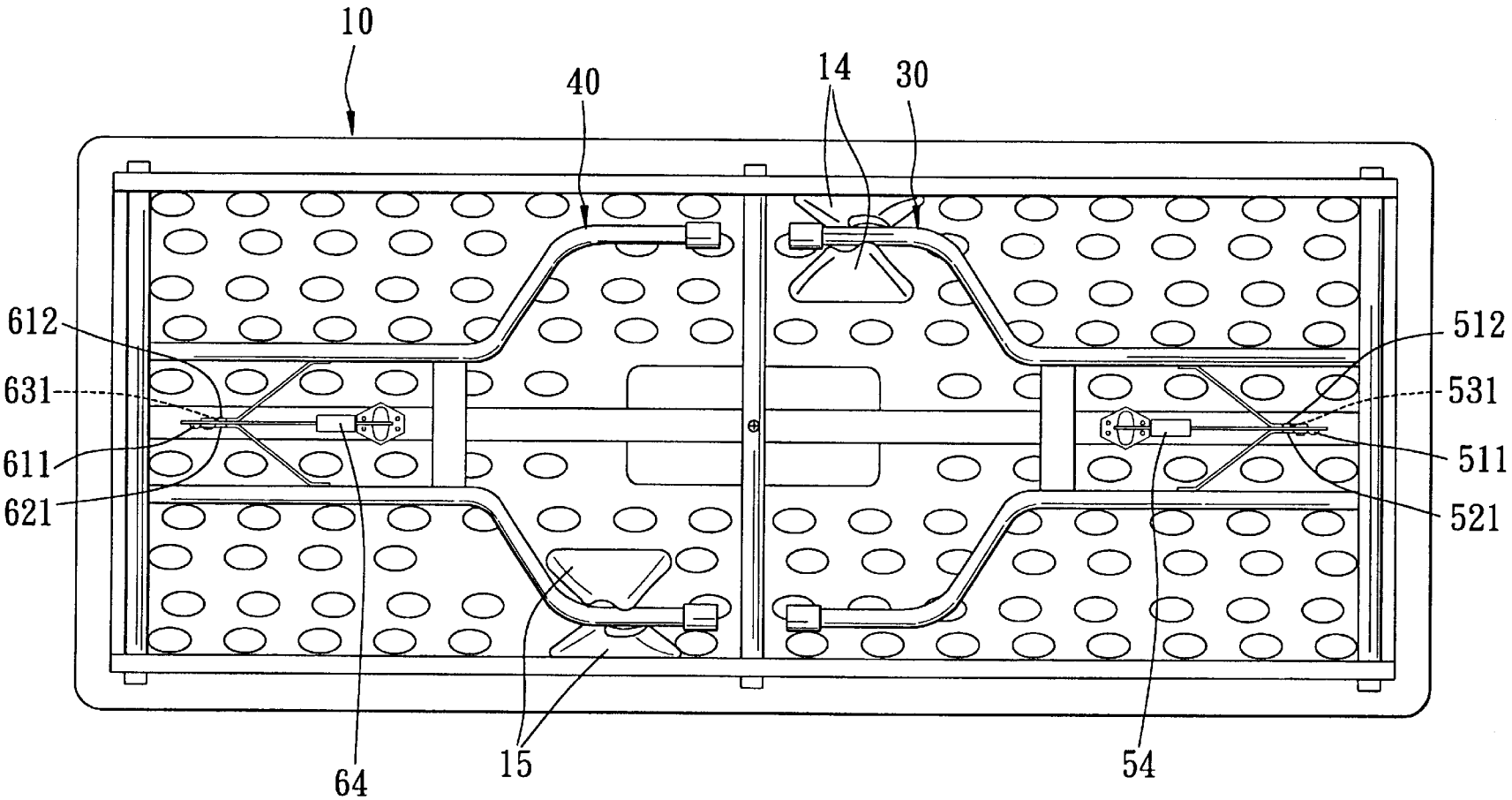
FIG. 6 is a schematic bottom view of the preferred embodiment of the folding table according to this invention in a collapsed state.

Moreover, the bottom surface of the table top 10 is formed with a pair of mounts 11, 12 that protrude from the bottom surface on opposite sides of the support rail 26. Each of the mounts 11, 12 is formed with a notch 111, 121 for engaging the cross rail 25. The bottom surface of the table top 10 is further formed with a longitudinal recess 13 for receiving the support rail 26. The bottom surface of the table top 10 is further formed with a pair of securing members 14, 15 for securing releasably and respectively the support pedestals 30, 40 when the support pedestals 30, 40 are folded toward the bottom surface of the table top 10 to collapse the table, as best shown in FIG. 6.

Figure 7:
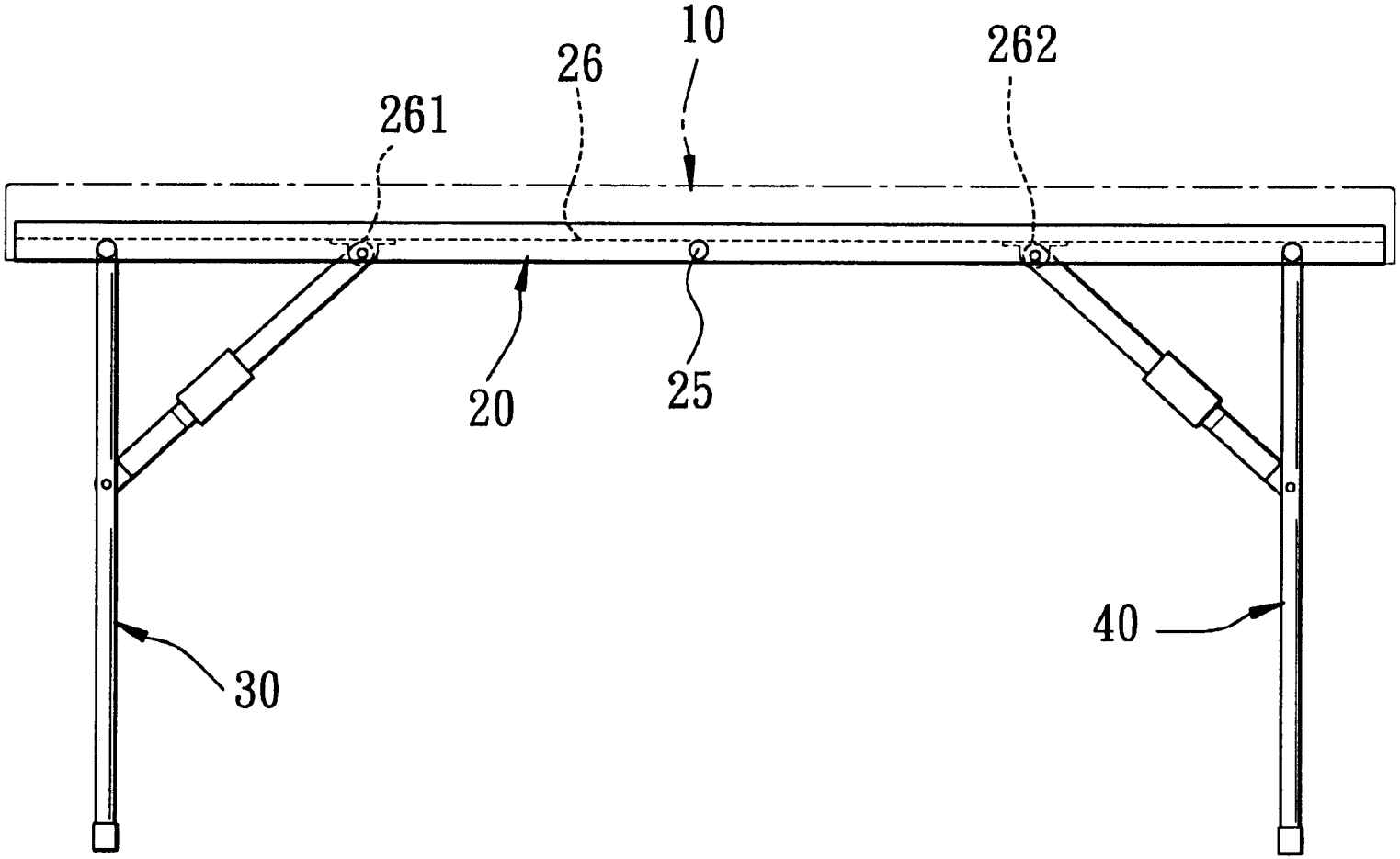
FIG. 7 is a schematic view of the preferred embodiment of the folding table according to this invention in an extended state.

Referring to FIG. 7, when a load is borne on the table top 10 of the folding table of this invention, the longitudinal support rail 26, and the two supporting points 261, 262 thereof can provide additional support to bear the load sufficiently and evenly as compared to the folding table disclosed in the aforesaid U.S. patent. Moreover, since the folding table of this invention provides more supporting points for bearing the load than the folding table disclosed in the aforesaid U.S. patent, the folding table of this invention is less susceptible to deformation.

Additionally, the engagement between the notches and the projections provided on the support braces can help position the support braces in the unfolded and folded states.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A folding table, comprising:

a pair of support pedestals spaced apart from each other in a longitudinal direction, each of said support pedestals having a top end formed with an end rail that extends in a transverse direction transverse to the longitudinal direction, and a bottom end adapted to be placed on a ground surface, said end rail having distal end segments opposite to each other in the transverse direction, and an intermediate segment between said distal end segments;

a longitudinal support rail that extends in the longitudinal direction and that has opposite rail ends disposed respectively on top of said intermediate segments of said end rails of said support pedestals;

a pair of foldable support braces, each of which includes a pedestal connecting portion and a rail connecting portion, said pedestal connecting portion having a first end connected pivotally to a respective one of said support pedestals, and an opposite second end, said rail connecting portion having a first end connected pivotally to said support rail, and an opposite second end connected pivotally to said second end of said pedestal connecting portion; and a table top having a top surface and a bottom surface, said support rail abutting against said bottom surface of said table top, said end rails of said support pedestals being pivotally retained on said bottom surface of said table top wherein said bottom surface of said table top is formed with a longitudinal recess for receiving said support rail.

2. The folding table of claim 1, wherein said rail connecting portions of said support braces are connected pivotally to said support rail at two supporting points that are spaced apart from each other along the longitudinal direction.

3. The folding table of claim 1, further comprising:

a pair of side rails that extend in the longitudinal direction, that are spaced apart from each other in the transverse direction, and that have said support rail disposed therebetween, each of said side rails having opposite ends connected pivotally and respectively to an adjacent pair of said distal end segments of said end rails of said support pedestals, each of said side rails being mounted securely on said bottom surface of said table top; and a cross rail that extends in the transverse direction, that is disposed between said end rails of said support pedestals, and that is spaced apart from said end rails in the longitudinal direction, said cross rail having opposite rail ends connected respectively to said side rails, and an intermediate rail portion that is disposed between said rail ends, said intermediate rail portion being disposed below and supporting said support rail thereon.

4. The folding table of claim 3, further comprising a screw fastener for fastening said cross rail to said support rail.

5. The folding table of claim 3, wherein said bottom surface of said table top is formed with a pair of mounts that protrude from said bottom surface on opposite sides of said support rail, each of said mounts being formed with a notch for engaging said cross rail.

6. The folding table of claim 1, wherein each of said support braces further includes a locking collar sleeved on said rail connecting portion and slidable therealong so as to conceal said second ends of said pedestal connecting portion and said rail connecting portion therein in order to maintain said support brace in an unfolded state.

7. The folding table of claim 1, wherein one of said pedestal connecting portion and said rail connecting portion of each of said support braces is formed with a notch, the other of said pedestal connecting portion and said rail connecting portion of each of said support braces being formed with a projection that extends into said notch so as to help position said support brace in an unfolded state.

8. The folding table of claim 1, wherein one of said pedestal connecting portion and said rail connecting portion of each of said support braces is formed with a notch, the other of said pedestal connecting portion and said rail connecting portion of each of said support braces being formed with a projection that extends into said notch so as to help position said support brace in a folded state.

9. The folding table of claim 1, wherein said bottom surface of said table top is formed with a pair of securing members for securing releasably and respectively said support pedestals when said support pedestals are folded toward said bottom surface of said table top to collapse the table.

* * * * *